United States Patent [19]

Hoverson

[11] Patent Number: 4,542,602

[45] Date of Patent: Sep. 24, 1985

[54] METHOD AND APPARATUS FOR MAKING A ROMAN SHADE

[76] Inventor: William D. Hoverson, c/o Dale's Draperies Inc., 12540 SE. Division, Portland, Oreg. 97236

[21] Appl. No.: 394,448

[22] Filed: Jul. 1, 1982

[51] Int. Cl.[4] ..... D06C 3/08; A41H 43/00

[52] U.S. Cl. ..... 38/102.1; 223/34

[58] Field of Search ..... 38/102.1; 223/28, 33, 223/34, 30; 160/348

[56] References Cited

U.S. PATENT DOCUMENTS

| | | | |
|---|---|---|---|
| 1,088,456 | 2/1914 | Schefer | 223/28 X |
| 1,822,104 | 9/1931 | McCarthy | 38/102.1 |
| 2,850,218 | 9/1958 | Gibson et al. | 223/28 X |
| 2,954,907 | 10/1960 | Bird | 223/30 |
| 3,147,895 | 9/1964 | Boyes | 38/102.1 |
| 3,964,186 | 6/1976 | Strickland | 38/102.1 |

*Primary Examiner*—Werner H. Schroeder
*Assistant Examiner*—Andrew M. Falik
*Attorney, Agent, or Firm*—Klarquist, Sparkman, Campbell, Leigh & Whinston

[57] ABSTRACT

A generally upright fabric sheet supporting frame has a transversely extending pleater support mounted thereto. Plural elongated pleaters are slidably mounted to the pleater support and are aligned in a transversely extending generally horizontal row. These pleaters are selected for the desired size of pleat, are adjusted to a desired position along the row, and are then releasably clamped in place. The fabric sheet is folded about projecting portions of these pleaters and secured together, as by flat washers and a hollow rivet, at spaced apart locations. Curtain raising and lowering cords are threaded through apertures of the washers and the rivet. The pleat is removed from the pleaters, and the fabric and pleater support are moved relative to one another to position a section of unpleated fabric adjacent the pleaters. This unpleated fabric is then pleated in the same manner. This cycle is repeated until the shade is complete. The upper edge of the fabric sheet is secured to a movable frame top member which is raised and lowered by a winch mechanism to move the sheet relative to the pleaters. The ends of the top member are slidably connected to respective side rails of the frame for centering and guidance purposes. The top member is also adjustable so as to place it in a horizontal plane.

20 Claims, 18 Drawing Figures

FIG. 9
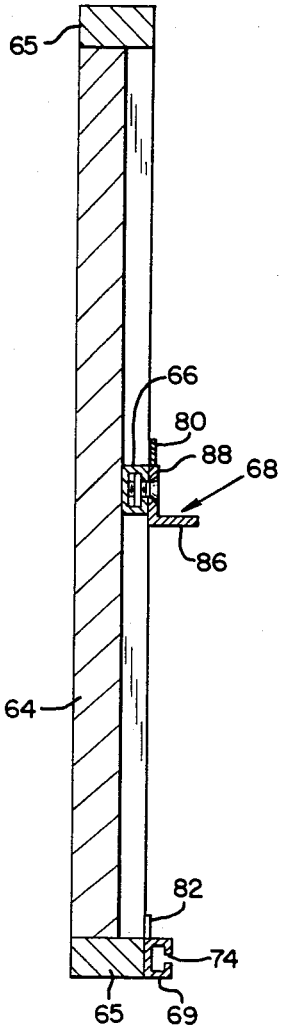
FIG. 8
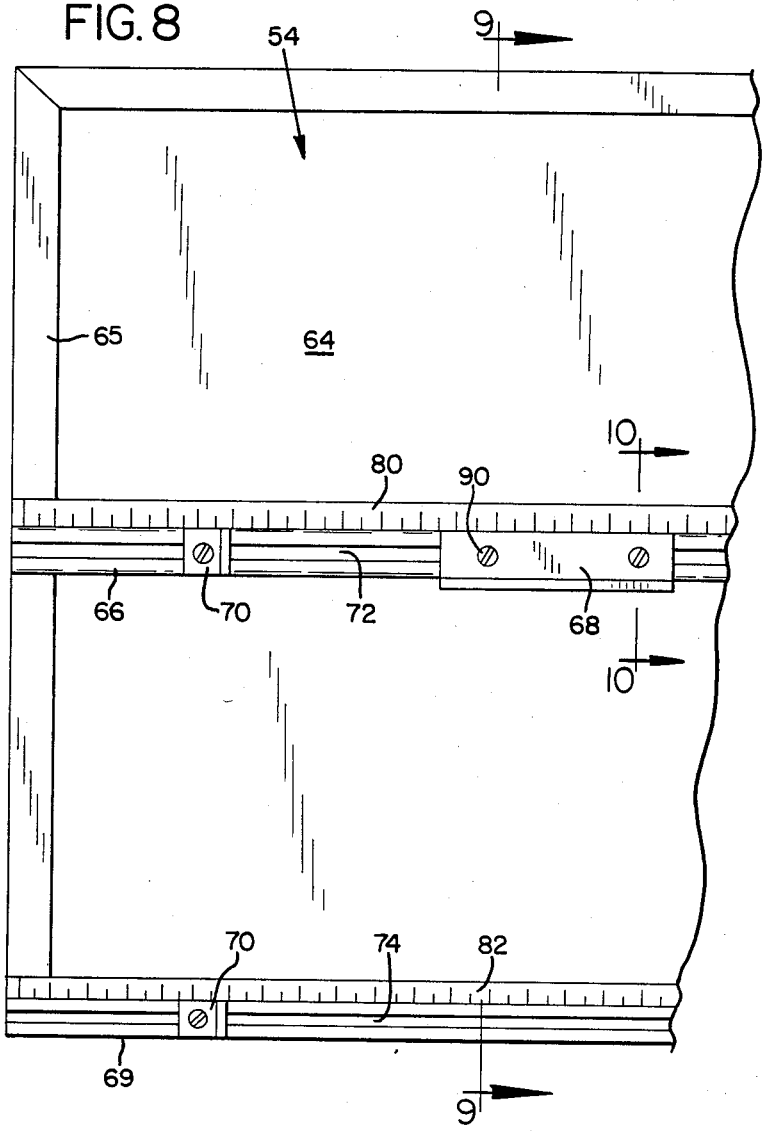
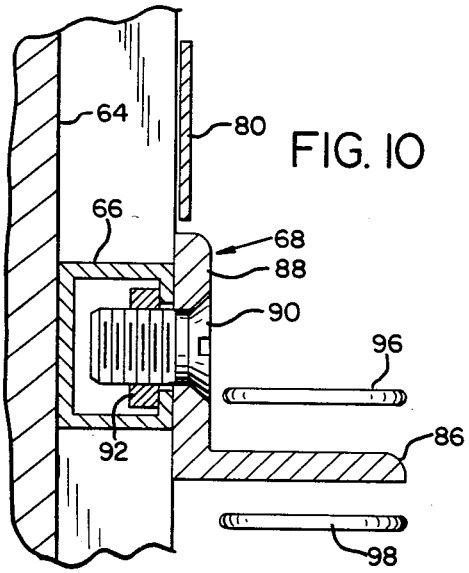
FIG. 10

METHOD AND APPARATUS FOR MAKING A ROMAN SHADE

BACKGROUND OF THE INVENTION

1. Field of the Invention

The present invention relates to an apparatus and method for making Roman shades with plural horizontal pleats, each pleat being secured together at spaced locations along its length.

2. Description of the Prior Art

Heretofore Roman shades have been made in a labor intensive manner. Typically, such shades have been produced by positioning a sheet of flexible material or fabric on a flat table, forming pleats in the fabric, and then sewing the pleats. With this approach, the production of Roman shades has been relatively labor intensive, slow, and costly.

SUMMARY OF THE INVENTION

The present invention includes a generally upright frame to which a transversely extending pleater support is mounted. A pleater mechanism for forming pleats in a sheet of flexible material, such as fabric, is mounted to the pleater support. In the illustrated embodiment, this pleater mechanism comprises plural elongated pleaters aligned in a transversely extending generally horizontal row. These pleaters are slidably mounted to the pleater support so as to be adjustable to a desired position along the row and are releasably clamped in place to the pleater support. The sheet of fabric is folded about projecting portions of these pleaters and then temporarily held in place to form a pleat. The fold of fabric forming the pleat is secured together, as by pairs of flat washers each pair being held together by a hollow rivet, at spaced apart locations along the pleat.

As more specific features of the invention, the frame includes first and second upright side rails with an elongated top member extending transversely between and slidably connected at its ends to the side rails. The top member is centered and guided by the side rails and also adjustable to be horizontal. An upper edge of a sheet of fabric is secured to the top member. Raising and lowering the top member, as by a manually operated cable and winch assembly, causes a corresponding movement of the sheet. Also, the pleater support is fixedly mounted to the frame. Therefore, movement of the top board moves the fabric sheet relative to the pleater support and thus relative to the pleaters so that unpleated portions of the sheet may be moved into position for pleating.

As still another feature of the invention, the top member includes a side pointer projecting outwardly from one end thereof along a scale mounted to the side rail for calibrating and monitoring the spacing between the pleats. In addition, a spring tape is mounted to one of the side rails As the top member is raised or lowered, the spring tape and pointer provide visual indications of the spacing between the pleats.

As still another feature of the invention, a material holding box at the base of the frame receives and holds the unpleated lower portions of the fabric sheet.

As a further feature of the invention, the frame is provided with a system of pulleys and eyes through which shade operating cords are fed to the shade as it is manufactured.

As another feature of the invention, the pleater support includes a horizontal pleater receiving track comprising a rectangular box-shaped slotted channel, the pleaters being slidably mounted to this track.

As a further specific feature of the invention, the pleaters comprise L-shaped angular pleater elements of lengths which vary, depending upon the size of the pleats to be formed in the fabric. The pleaters are moved along the pleater track to desired locations, such as indicated by a scale along the pleater track, and then releasably secured in place. One leg of each pleater element projects outwardly from the pleater support and comprises a portion of the pleater about which the fabric is folded to form the pleat.

As another feature of the invention, such side cloth guides are slidably mounted to the pleater support for movement to desired locations to accommodate sheets of fabric of varying widths. A securing mechanism is provided for releasably holding the side cloth guides at the desired location.

As a further feature of the invention, a pair of side cloth guides is slidably mounted to the pleater receiving track.

As still another feature of the invention, a side cloth guide receiving track is mounted to the pleater support and is parallel to, and spaced below, the pleater receiving track. A second pair of side cloth guides is slidably positioned within the side cloth guide receiving track.

It is accordingly one object of the invention to provide an improved method and apparatus for making a Roman shade.

It is still another object of the invention to provide a method and apparatus for making a Roman shade which reduces the labor and time required for making such shades.

Another object of the invention is to provide a Roman shade which a consumer may easily disassemble and reassemble for cleaning purposes.

A further object of the invention is to provide a method and apparatus capable of making a Roman shade from a wide variety of materials.

A further object of the invention is to provide a method and apparatus for making a Roman shade which reduces the costs and time required to make such shades.

A still further object of the invention is to provide a shade having pleats secured together by a means which improves the strength of the shade, enhances its life and provides an attractive dimensional appearance to the pleats of the shade.

These and other objects, features and advantages of the invention will become apparent from the drawings and description below.

BRIEF DESCRIPTION OF THE DRAWINGS

FIG. 8 is an enlarged front elevational view of a portion of the pleater support of the FIG. 6 apparatus;

FIG. 9 is a vertical sectional view of the pleater support of FIG. 8, taken along lines 9—9 thereof;

FIG. 10 is an enlarged view of the pleater of FIG. 8, taken along lines 10—10 of FIG. 8, with temporary fabric holders also being shown in this figure;

DETAILED DESCRIPTION OF PREFERRED EMBODIMENT

Roman Shade

Figure 3:
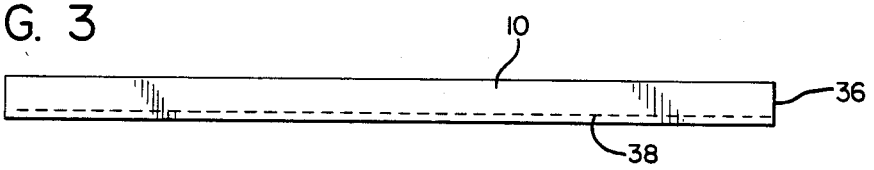
FIG. 3 is a top plan view of the Roman shade of FIG. 1.
Figure 1:
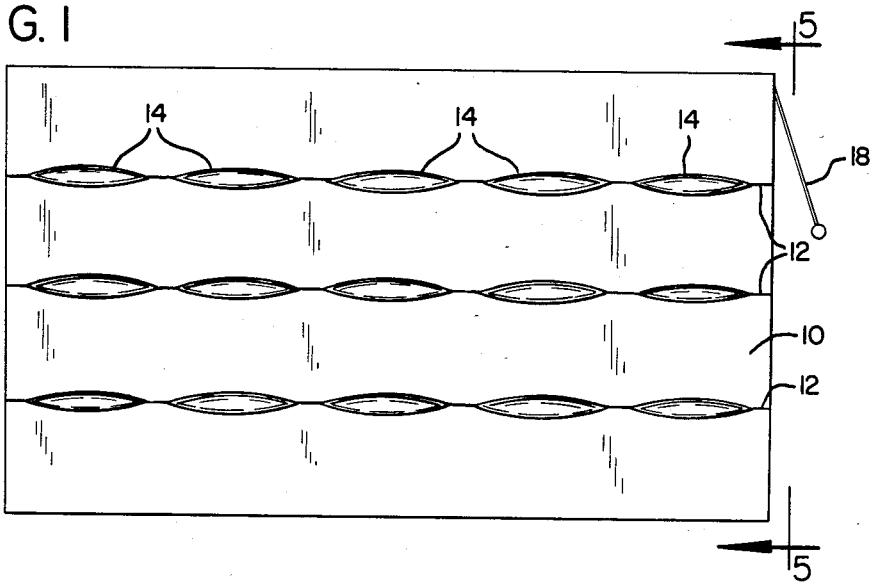
FIG. 1 is a front elevational view of a Roman shade manufactured in accordance with the method and apparatus of the invention.
Figure 5:
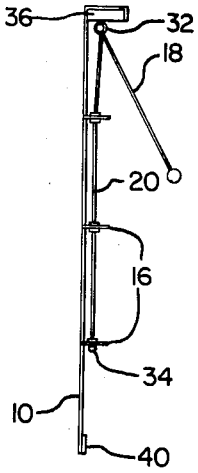
FIG. 5 is an end view of the Roman shade of FIG. 1, taken along lines 5—5 of FIG. 2.
Figure 2:
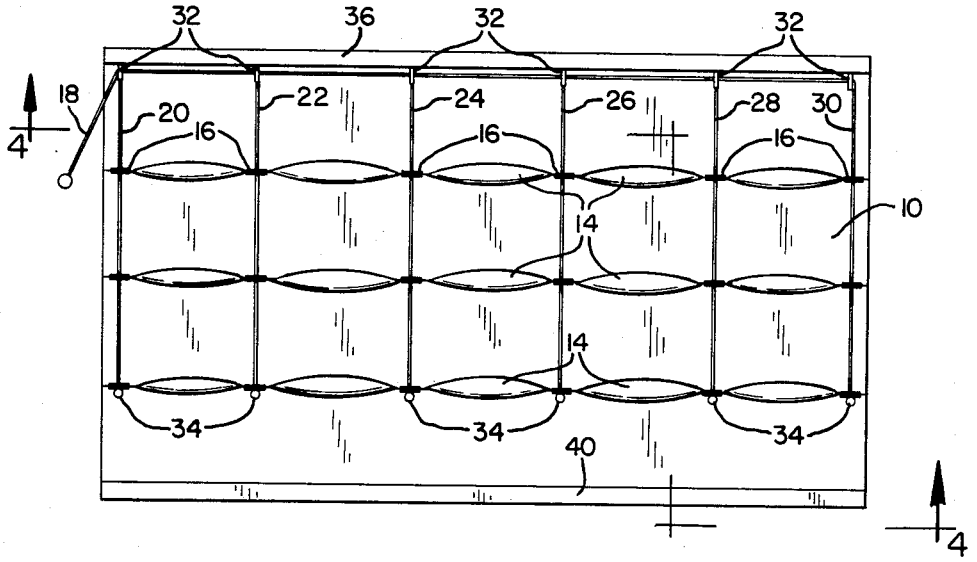
FIG. 2 is a rear elevational view of the Roman shade of FIG. 1.
Figure 4:
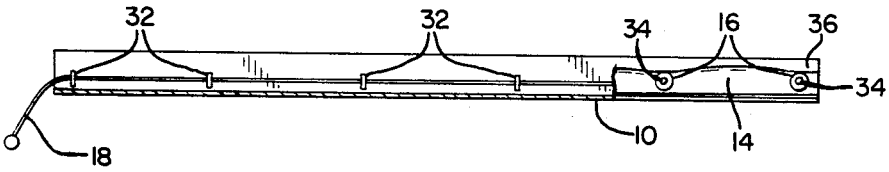
FIG. 4 is a bottom view of the Roman shade of FIG. 1, partially in section, taken along lines 4—4 of FIG. 2.
Figure 7:
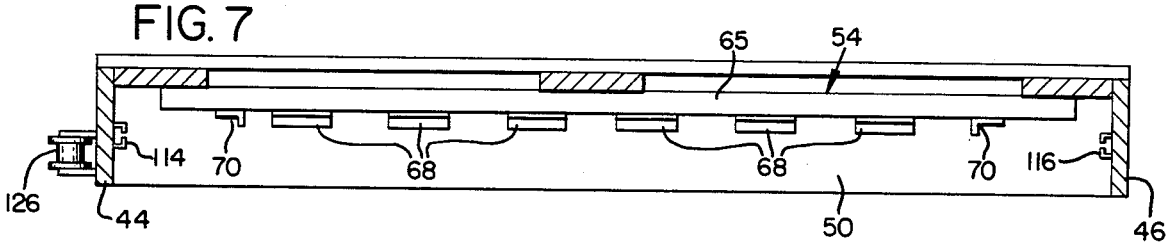
FIG. 7 is a cross-sectional view of the apparatus of FIG. 6, taken along lines 7—7 thereof.

A Roman shade made in accordance with the method and apparatus of the present invention is shown in FIGS. 1–5. It comprises a generally rectangular upright sheet of flexible cloth or material 10 with plural parallel horizontal rows 12 of pleats 14. The pleats 14 are formed from folds of the material 10, the folds being held together between a pair of washers 16 (described in greater detail in connection with the discussion of FIGS. 17 and 18 below) to give the shade a desirable pleated affect. That is, the washers are held together by a rivet or eyelet 17, described below, to pinch or wedge the fabric therebetween and form the pleat. The washers are spaced apart along the rows from six to eighteen inches, depending upon the width of the shade and the number of pleats desired. Also, the rows of pleats are spaced vertically from six inches to ten inches apart.

With this construction, the front of the shade presents a reverse pleated effect. Also, spaces between the pleats separate slightly for a dimensional appearance. The pleats illustrated in the drawing are one inch deep, with the folds being positioned at the back side of the shade.

The shade fold up in an orderly manner. That is, the shade is raised or lowered by a cord 18 comprised of multiple cord sections 20, 22, 24, 26, 28 and 30. Each of these cord sections, for example, cord section 20, extends through a respective vertically aligned set of washers and pivots. A stop 34, attached to the lower end of each cord 20–30, engages the bottom side of the lowest washer of the associated set. The cord sections also each extend through eyelets 32 mounted to an elongated top board 36 to which the upper edge of the shade is fastened by staples 38. Thus, as cord 18 is pulled downwardly in FIG. 2, the lowest row of pleats and lower portion of the fabric sheet 10 are raised until the next row of pleats is reached. Continued pulling of cord 18 in this downward direction raises the lowest and next row of pleats, and so on until the shade is raised. Conversely, when cord 18 is raised upwardly, the shade is lowered.

The shade is held square and true by wood cross slats (not shown) extending transversely between the side edges of the shade. Also, a hem 40 is provided along the bottom edge of the shade to permit adjustment of the length of the shade.

Apparatus for Making a Roman Shade

Figure 6:
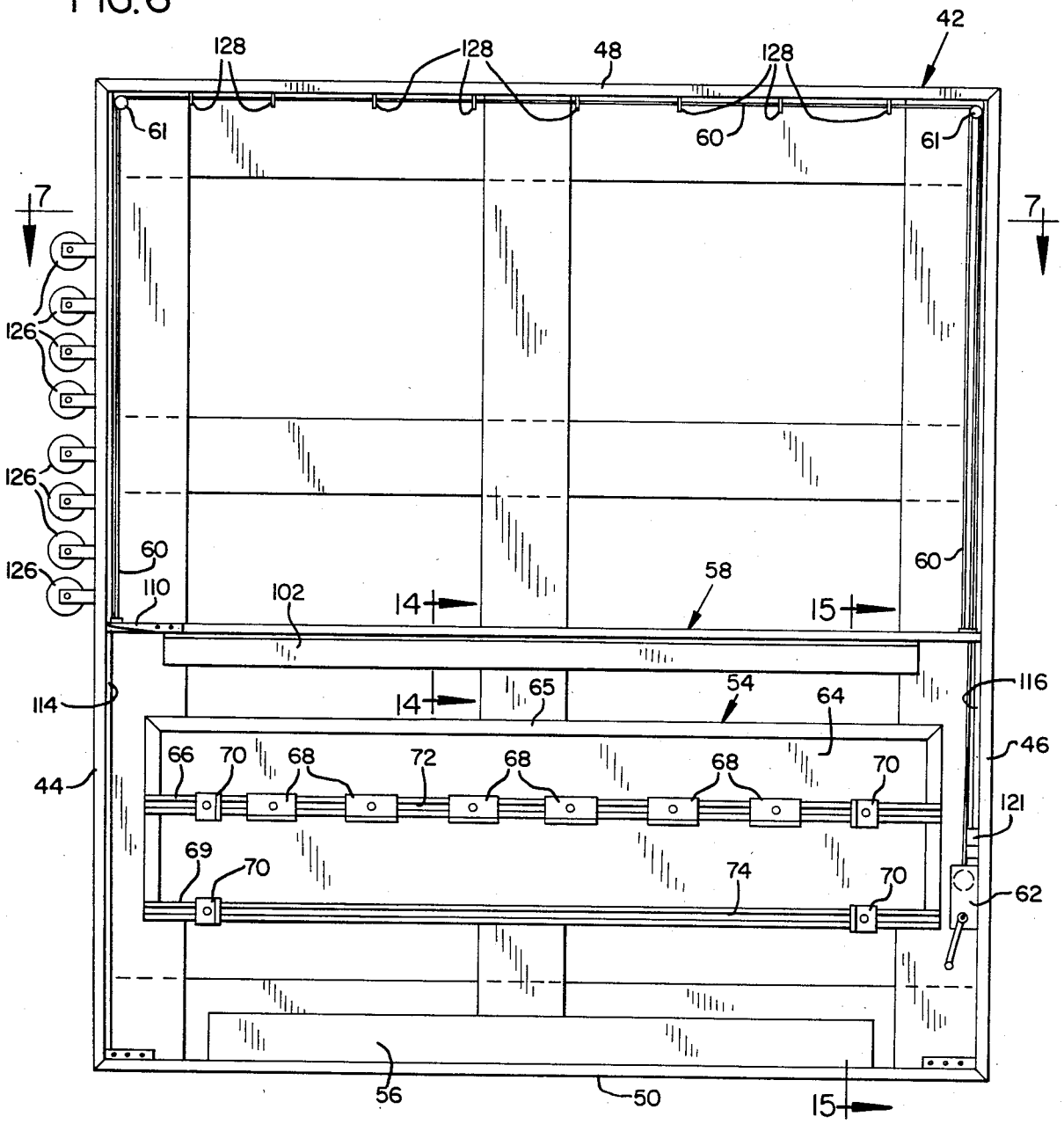
FIG. 6 is a front elevational view of an apparatus for making a Roman shade in accordance with the invention.
Figure 13:
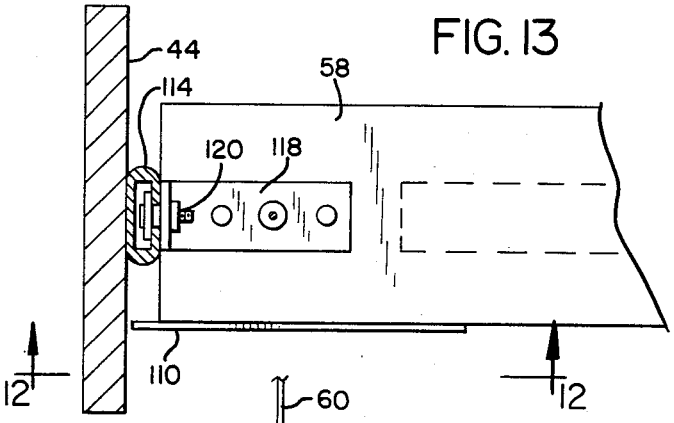
FIG. 13 is a top view, partially in section, of a portion of the side rail and top member of the apparatus of FIG. 6, taken along lines 13—13 of FIG. 12.

The apparatus for making a Roman shade in accordance with the invention will be understood with reference to FIGS. 6 through 18. As shown in FIG. 6, the apparatus includes an upright rectangular rack or frame 42 of interconnected frame members. Frame 42 includes first and second vertically upstanding, parallel, spaced apart side rails 44, 46, a top frame member 48 interconnecting the upper ends of the side rails, and a bottom frame member 50 interconnecting the lower ends of the side rails. Frame 42 is rigid with suitable reinforcing pieces. The frame has sufficient strength and rigidity to support a pleater support 54 and a material holding box 56 for holding the unpleated portions of the fabric sheet 10. The frame also supports a movable top board member 58 connected to the frame by a top board suspension system including cables 60, pulleys 61, and a top board raising and lowering mechanism 62. Thefunctioning of these components of the apparatus is explained below.

Pleats in the sheet of material 10 are formed on a pleating system including a pleater support or board 54. As illustrated, the pleater board comprises a rectangular panel 64 surrounded by a frame 65 which is securely mounted to the frame 42. A first horizontal steel track 66, of rectangular box-like construction, extends transversely from one side edge of the pleater support 54 to the other. Track 66 may be recessed into pleater support 54. Plural pleaters 68, explained in greater detail below, are slidably mounted to track 65 and used to form pleats in the sheet 10. In addition, side cloth guides 70, for centering and guiding the side edges of sheet 10 as the shade is made, are slidably mounted to the track 65. One of such side cloth guides 70 is positioned adjacent one end of the track and the other of the side cloth guides is positioned adjacent the other end of the track. Guides 70 are slidable to accommodate sheets of fabric of various widths. The pleaters 68 and side cloth guides 70 are connected to the track 66 so as to slide along an outwardly opening, longitudinally extending slot 72 of the track.

Also, a lower horizontal track 69, which is similar to track 66, is mounted along the bottom edge of the pleater support 54 for holding additional side cloth guides 70. Like track 66, track 68 is also provided with a slot 74.

A first graduated scale 80 is mounted to the pleater support 54 adjacent to and along the upper edge of the track 66. Also, a second graduated scale 82 is mounted to the pleater support 54 adjacent to and along the upper edge of the track 68. These scales read from the center of the frame towards the edge. They are utilized for accurate determination of the desired position of the pleaters 68 and side cloth guides 70 according to precalibrated charts for the size of the shade being made.

Figure 11:
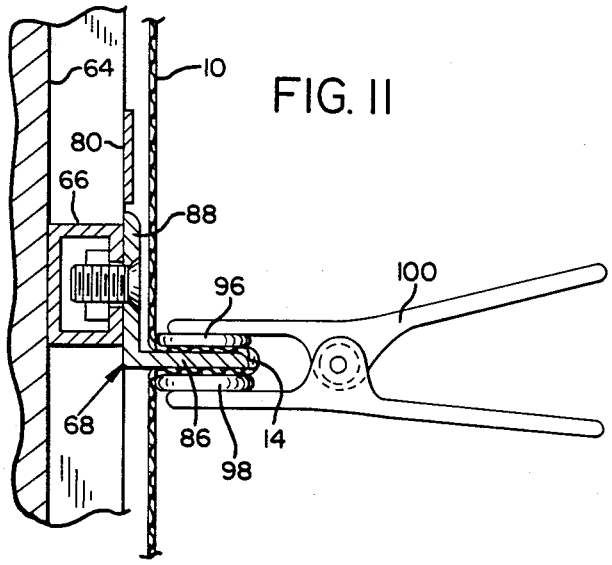
FIG. 11 is a view of the pleater like FIG. 10, except also showing a sheet of fabric temporarily held in place about the pleater to form a pleat.

With reference to FIGS. 9, 10 and 11, the pleaters have an outwardly projecting portion about which fabric is folded to form the pleats. More specifically, the pleaters 68 comprise pleaters of right angular cross section having a leg 86, positioned in a horizontal plane, which projects outwardly from the pleater board 64 and another leg 88 positioned adjacent the track 66. These pleaters may be of aluminum and are of varied length such as eight, ten and twelve inches, depending upon the desired size of the pleats.

Pleaters 68, as mentioned above, are slidably secured to the track 66. The pleaters are positioned along the track 66 in accordance with precalibrated charts for the shade width. Such charts specify the width of the pleats, the number of pleaters used, and the setting of the pleaters along the scales 80. Also, the side cloth guides 70 are positioned along their respective tracks 66, 69, and engage the side edges of the sheet 10 and center the sheet. The pleaters 68 and side guides 70 are releasably clamped in place with a mechanism best seen in FIG. 10. As shown, screws 90 extend through one or more apertures in the pleater legs 68, the slot 72, and into the interior of the track 66. A nut 92, within the interior of track 66, threadedly engages the screw 90. When the screw is tightened, a portion of the track 66 is wedged between nut 92 and pleater leg 88 and the pleater is held in the desired position. The side cloth guides 70 are of similar L-shaped construction, except that the outwardly projecting legs of the side cloth guides are positioned in vertical planes to engage and guide the vertical side edges of the sheet 10.

With reference to FIG. 11, pleats are formed in the fabric by folding an unpleated portion of the sheet 10 about the leg 86 of a pleater 68. Elongated cloth holders 96, 98 are positioned against the respective upper and lower surfaces of the folded material and a manually operated clamp 100 temporarily retains the cloth holders 96, 98 and folded pleat 14 in position about the pleater leg 86.

Figure 16:
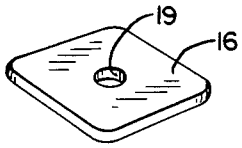
FIG. 16 is a perspective view of a pleat securing washer or plate in accordance with the invention.
Figure 17:
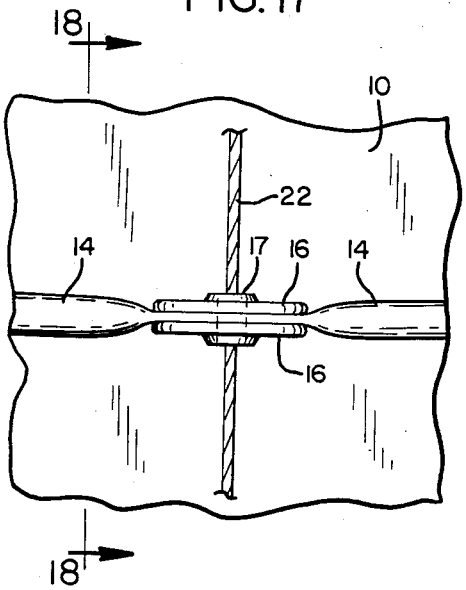
FIG. 17 is an enlarged view of a section of the shade of FIG. 2.
Figure 18:
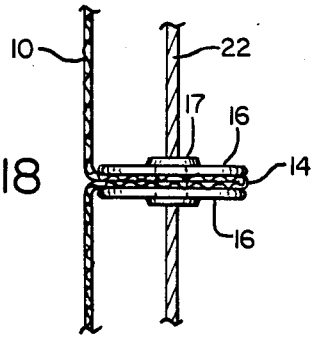
FIG. 18 is a vertical sectional view of a portion of the shade of FIG. 17, taken along lines 18—18 thereof.

When so held, washers 16, as shown in FIG. 16, are positioned as shown in FIGS. 17 and 18 along opposite sides of the pleat 14 and adjacent the pleaters. An eyelet 17 is inserted through the fabric and apparatus 19 of the washers and then secured in place. Thus, the washers 16 are retained in place to hold the pleat 14 after the temporary holders 96, 98 are removed. Because of the gaps between adjacent pleaters, the eyelets may be inserted through the fabric while the pleat is temporarily formed over the pleater legs.

Figure 12:
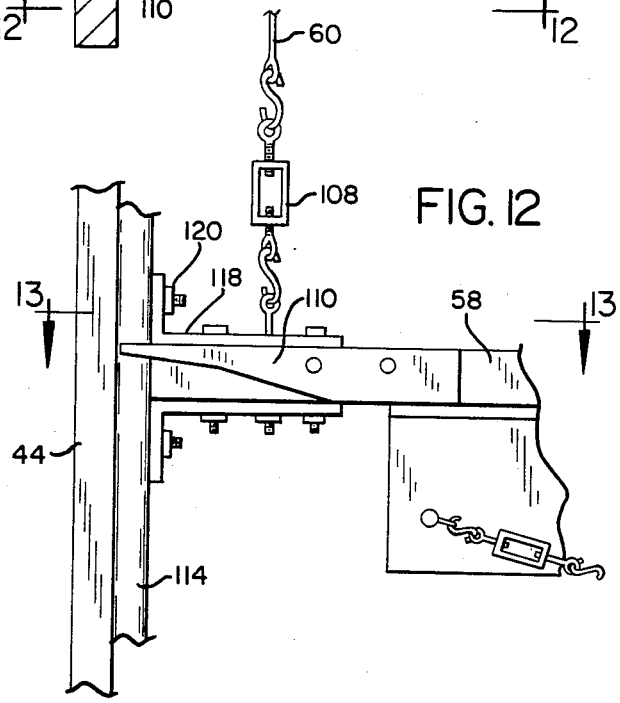
FIG. 12 is an enlarged elevational view of a portion of the side rail of the apparatus of FIG. 6, taken along lines 12—12 of FIG. 13.
Figure 14:
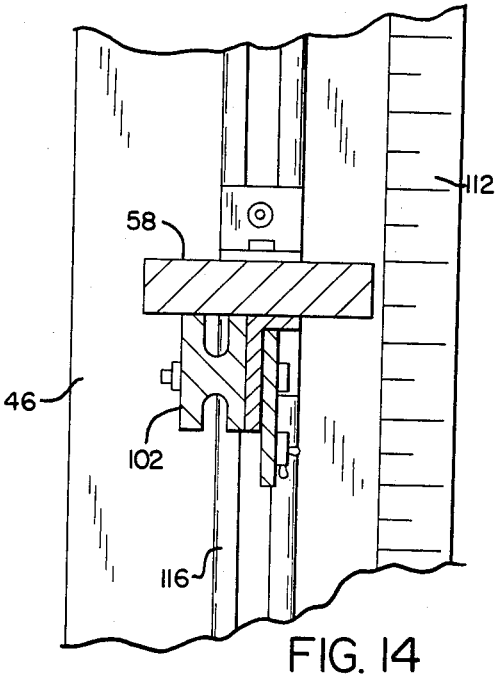
FIG. 14 is a sectional view, taken along lines 14—14 of FIG. 6, of a portion of the top member and side rail of the apparatus of FIG. 6.

With reference to FIGS. 6 and 12–15, the top board holding system is mounted to the frame or rack 42. This system includes a top board member 58 to which the top board 36 of the shade is attached, following the securing of the shade to the top board. Thus, upon raising and lowering of the top board holder 58, by operating winch mechanism 62, connected via cables 60 and pulleys 61 to the top board member 58, the fabric sheet 10 is correspondingly raised and lowered. The top board member 58 is provided with metal stiffeners 102 (FIG. 14) to regulate the top board holder or member 58. With reference to FIG. 12, an adjustment mechanism is provided for adjusting the top board holder 58 to horizontal. This mechanism includes a turnbuckle 108 in the cable line 60 for adjusting the length of cable 60. Side pointers, such as pointer 110 in FIG. 12, may be provided along the side edges of the top board 58. Side pointer 110 extends towards the side rail 44 and provides a visual indication of the position of the top board, and hence of the sheet of fabric connected thereto. A scale 112 (FIG. 14) may be provided along the side rails (i.e., side rail 46) to enhance the visual indication of the relative elevation of the top board 58.

Vertically extending steel tracks 114, 116 having respective outwardly opening channels are mounted to the respective frame side rails 44, 46. These tracks are set back from the front edge of frame 42. The respective ends of the top board holder 58 (see FIG. 13) slidably engage the respective tracks 114, 116 such that the top board holder is centered and guided as it moves upwardly and downwardly. Master slide bases or brackets 118 are mounted to the upper and lower surfaces of top board holder 58. These brackets include a track engaging mechanism 120 (FIG. 13) like that for slidably connecting the pleaters 68 to the pleater track 66.

Figure 15:
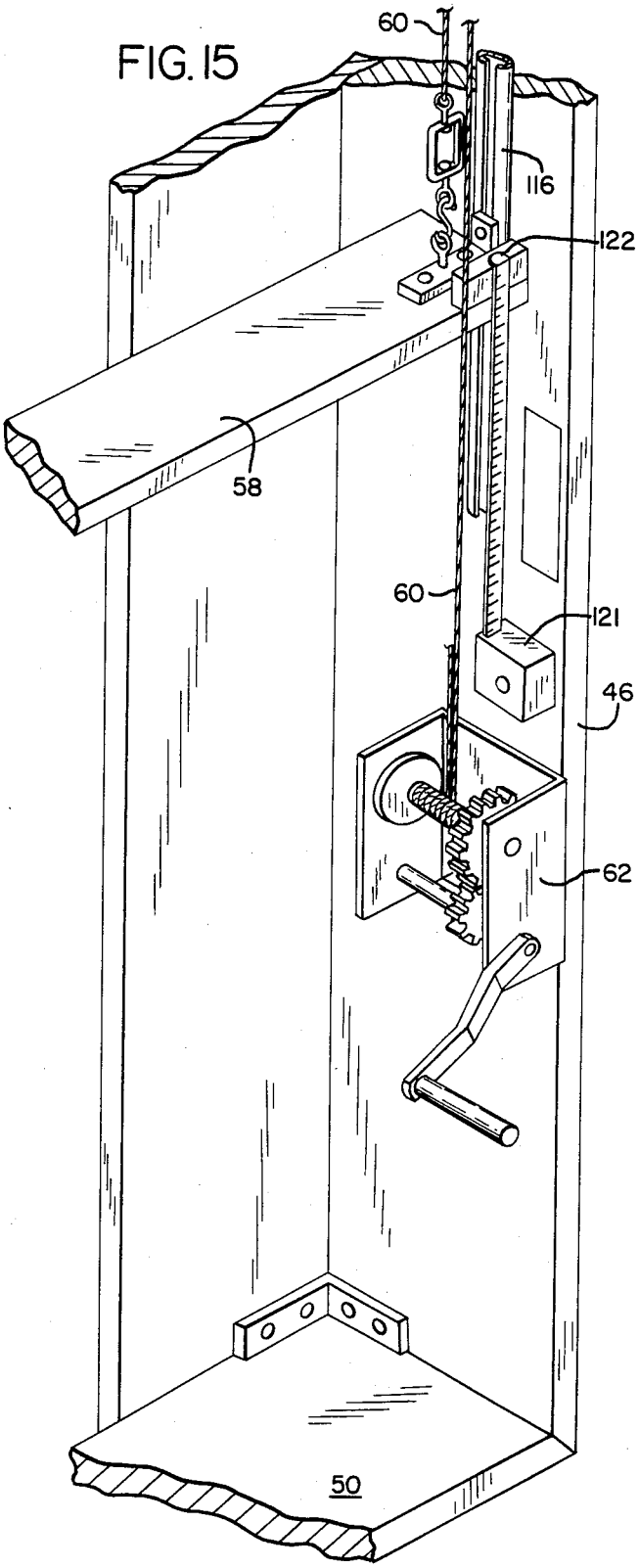
FIG. 15 is a perspective view of a portion of the apparatus of FIG. 6, taken along lines 15—15 thereof, and illustrating a top member raising and lowering mechanism in greater detail.

Also, as shown in FIG. 15, a spring biased tape 121 is mounted to frame side rail 46. Tape 121 has its free or zero indicating end 122 connected to top board holder 58. Thus, as the top board holder 58, and the connected assembly of top board 36 and attached sheet 10, are raised and lowered, the tape 121 provides a visual indication of the vertical position of the sheet.

The frame 42 also includes a mechanism (FIG. 6) for holding the shade raising and lowering cords 20–32 and feeding these cords to the shade as the shade is made. This system includes a series of pulleys or reels 126 mounted to the side rail 44. Each of these pulleys holds a cord which is fed through eyelets 128 secured to the underside of top frame member 58 and vertically downwardly to associated pleats.

After a row 12 of pleats is completed, the top board holder 58 is raised a desired distance as determined by precalibrated charts, to position an unpleated portion of fabric against the pleaters 68 on the pleater support 54. Thereafter, a subsequent row of pleats is formed, and another portion of the fabric is moved into position for formation of an additional row of pleats.

Thus, a Roman shade is manufactured as follows. The pleaters 68 and side guides 70 are placed on the pleater support 54, adjusted to their desired positions, and clamped in place. A sheet of cloth is hemmed, pressed and stapled to the tob board 36. This top board 36 is then mounted to the top board holder 58 with the center of the sheet 10 at a mark (not shown) designating the center of the top board holder 58. The top board holder is then adjusted to horizontal using turnbuckles 108. The sheet 10 is suspended or dropped from the back of the top board holder 58 so as to pass between the top board holder and pleater support 54, with the front of the sheet of material facing the pleater support.

The top board holder 58 is raised or lowered as required to position the top board holder, and hence the sheet 10, as desired. The position is visually indicated by pointers 110 and tape 121 with the desired position being established pursuant to precalibrated charts for the desired vertical spacing of the pleats.

The pleats are formed by folding the cloth around the horizontal projecting pleater legs 86 of the pleaters 68, with the folded material being temporarily held in place by the cloth holders 96, 98 and clamp 100 until the pleats are secured by the washers 16. Hollow eyelets 17 fasten the washers 16 together with the fold or pleat of fabric between them. After the pleats are secured, the cloth holders are removed. Winch 62 is then operated to raise the top board holder to the next setting as indicated by the precalibrated charts. The cords 20–32 raise the sheet 10 as the top board holder 58 is moved. Also, cross slats are inserted (not shown) above the pleats and secured at each side edge of the shade to give the shade additional rigidity.

After a row of pleats 114 (FIG. 1) is complete, the cycle is repeated until the required number of horizontal rows of pleats 12 are finished. The shade is then removed and finished with procedures standard in a Roman shade making industry.

Having illustrated and described the principles of my invention with reference to one preferred embodiment, it should be apparent to those persons skilled in the art that such invention may be modified in arrangement and detail without departing from such principles.

I claim as my invention all such modifications as come within the true spirit and scope of the following claims:

1. An apparatus for making a Roman shade having plural horizontal rows of pleats, each pleat being secured at spaced locations along its length, from a sheet of flexible material comprising:

an upwardly extending pleater support;

pleat forming means mounted to said pleater support for forming pleats in the sheet of material, said pleat forming means projecting outwardly from the pleater support and the surface of the sheet, and having sheet contacting edges aligned in a direction normal to the side edges of the sheet and normal to the direction in which the pleater support is extending upwardly such that folding of the material about said pleat forming portion forms a pleat in the material, said pleat forming means including gaps along its length so as to permit the securing of the folded pleat of material at the gaps while the material is folded about the pleat forming means.

2. An apparatus according to claim 1 including side edge guiding means mounted to said pleater support for guiding the side edges of the sheet so as to prevent transverse shifting of the sheet relative to the pleater support as pleats are formed.

3. An apparatus for making a Roman shade having plural horizontal rows of pleats, each pleat being secured at spaced locations along its length, from a sheet of flexible material comprising:

a pleater support;

pleat forming means mounted to said pleater support for forming pleats in the sheet of material, said pleat forming means projecting outwardly from the pleater support and aligned in a direction normal to the side edges of the sheet such that folding of the material about said pleat forming portion forms a pleat in the material, said pleat forming means including gaps along its length so as to permit the securing of the folded pleat of material at the gaps while the material is folded about the pleat forming means, and said pleat forming means including plural spaced apart pleater elements positioned along the length of a common pleat or fold of the material each with a pleat forming portion projecting outwardly from said pleater support, the gaps comprising the spaces between said pleater elements.

4. An apparatus for making a Roman shade having plural horizontal rows of pleats, each pleat being secured at spaced locations along its length, from a sheet of flexible material comprising:

a pleater support;

pleat forming means mounted to said pleater support for forming pleats in the sheet of material, said pleat forming means projecting outwardly from the pleater support and aligned in a direction normal to the side edges of the sheet such that folding of the material about said pleat forming portion forms a pleat in the material, said pleat forming means including gaps along its length so as to permit the securing of the folded pleat of material at the gaps while the material is folded about the pleat forming means, said pleat forming means including plural spaced apart pleater elements positioned along the length of a common pleat or fold of the material each with a pleat forming portion projecting outwardly from said pleater support, the gaps comprising the spaces between said pleater elements; and said apparatus including pleater mounting means for slidably mounting said pleater elements to said pleater support for movement along the common fold, said apparatus further including pleater retaining means for releasably holding said pleater elements in desired positions.

5. An apparatus according to claim 4 in which said pleater mounting means releasably mounts said pleater elements to said pleater support so as to permit removal of said pleater elements from said pleater support and replacement of said removed pleater elements with pleater elements of different lengths than the removed pleater elements so as to form pleats of different size in a sheet of material.

6. An apparatus according to claim 5 in which said pleater elements each include a track engaging portion and a pleat forming leg projecting outwardly from the pleater support, the pleat forming legs being positioned in a common plane, the sheet being folded about the pleat forming legs to form a pleat, said pleater mounting means comprising a pleater track mounted to said pleater support and means for slidably mounting the track engaging portion of said pleater elements to said track, said pleater retaining means comprising means for releasably clamping the pleater elements to the pleater track.

7. An apparatus according to claim 6 including a first pair of side edge guides slidably mounted to the pleater track, first side edge guide mounting means for releasably retaining said first pair of side edge guides in desired positions adjacent the respective ends of the pleater track, a side edge guide track positioned parallel to and spaced from the pleater track, a second pair of side edge guides slidably mounted to the side edge guide track, second side edge guide mounting means for releasably retaining said second pair of side edge guides in desired positions adjacent the respective ends of the side edge guide track, said side edge guides each including a sheet guiding leg projecting outwardly from the pleater support and positioned in a plane normal to the plane containing the pleat forming legs, a first side edge guide of the first pair and a first side edge guide of the second pair having sheet guiding legs in a common plane, the second side edge guide of the first pair and second side edge guide of the second pair also having sheet guiding legs in a common plane, whereby said first and second pairs of side edge guides engage the side edges of the sheet.

8. An apparatus according to claim 7 in which said pleater elements and said side edge guides are of right angular construction, said apparatus including first scale means for indicating the position of said pleater means and said first pair of side edge guide means along the pleater track and second scale means for indicating the position of said second pair of side edge guide means along the side edge guide track.

9. An apparatus according to claim 5 including scale means for indicating the position of said pleater elements relative to said pleater support.

10. An apparatus for making a Roman shade having plural horizontal rows of pleats, each pleat being secured at spaced locations along its length, from a sheet of flexible material comprising:

a pleater support;

pleat forming means mounted to said pleater support for forming pleats in the sheet of material, said pleat forming means projecting outwardly from the pleater support and aligned in a direction normal to the side edges of the sheet such that folding of the material about said pleat forming portion forms a pleat in the material, said pleat forming means including gaps along its length so as to permit the securing of the folded pleat of material at the gaps while the material is folded about the pleat forming means; and including fastening means for securing the folded pleats of material at the gaps while the material is folded about the pleat forming means, said fastening means comprising first and second plates with central apertures positioned with the folded sheet between the plates, and hollow eyelet means for insertion through the apertures and fold of fabric forming the pleat to secure the plate together to thereby retain the pleat in the sheet.

11. An apparatus according to claim 9 including means for temporarily clamping the folded sheet to said pleat forming means, said last named means being removable following the installation of said fastening means.

12. An apparatus for making a Roman shade having plural horizontal rows of pleats, each pleat being secured at spaced locations along its length comprising:

an upright frame;

an elongated sheet holding member extending transversely across the frame which holds the upper edge of the sheet of material in a horizontal position;

suspension means for slidably mounting said sheet holding member to said frame for selective vertically upward and downward movement;

a pleater support mounted to said frame;

pleat forming means mounted to said pleater support for forming pleats in the sheet of material, said pleat forming means projecting outwardly from the pleater support and the surface of the sheet, being aligned in an outwardly extending horizontal plane and thereby normal to the side edges and surface of a support sheet, such that folding of the material about said pleat forming means forms a pleat in the material, said pleat forming means including gaps spaced along its length so as to permit the securing of the folded pleat of material at the gaps while the material is folded about the pleat forming means.

13. An apparatus according to claim 12 in which said suspension means comprises cable suspension means, said apparatus including winch means mounted to said frame and connected to said cable suspension means for taking up and playing out said cable suspension means to thereby selectively raise and lower the sheet of material to position unpleated portions of the sheet adjacent to the pleat forming means.

14. An apparatus according to claim 13 including adjustment means for adjusting said sheet holding member to adjust the upper edge of the sheet to a horizontal position.

15. An apparatus according to claim 13 in which said frame includes first and second upright side rails, said suspension means including first and second vertical tracks mounted to the respective frame side rails, means for slidably coupling a first end of said sheet holding member to said first track, and means for slidably coupling a second end of said sheet holding member to said second track, whereby said tracks guide the sliding motion of said sheet holding member.

16. An apparatus according to claim 13 including a material holding box mounted to said frame and positioned below said pleat forming means for holding unpleated portions of the sheet.

17. An apparatus according to claim 13 including means mounted to said frame for feeding shade operating cords to the pleats as they are formed, the shade operating cords being usable to raise a completed and installed shade by gathering the pleats.

18. An apparatus according to claim 13 including means for indicating the vertical position of said sheet holding member relative to the frame.

19. A method of making a Roman shade from a sheet of flexible material comprising:

folding the sheet about an elongated pleat forming member to form a first elongated pleat;

releasably clamping the material to the pleat forming member to temporarily hold the first pleat;

fastening the folded material together with fasteners positioned at spaced apart locations along the first pleat while the first pleat is clamped to the pleat forming member;

releasing the first pleat from the pleat forming member with the first pleat being retained by fasteners;

positioning and folding an unpleated portion of the sheet about an elongated pleat forming member to form a second elongated pleat which is parallel to the first pleat;

releasably clamping the material to the pleat forming member to temporarily hold the second pleat;

fastening the folded material together with fasteners positioned at spaced apart locations along the second pleat while the second pleat is claimped to the pleat forming member; and releasing the second pleat from the pleat forming member with the pleats being retained by the fasteners.

20. A method according to claim 19 including the steps of supporting the pleat forming member in a horizontal plane, suspending the sheet of material from a frame for movement in a vertical direction, and moving the sheet in a direction normal to the pleat forming member following the releasing of the first pleat to move the unpleated portion of the sheet into position for folding about the pleat forming member to form the second pleat.

* * * * *

UNITED STATES PATENT AND TRADEMARK OFFICE

CERTIFICATE OF CORRECTION

PATENT NO. : 4,542,602

DATED : September 24, 1985

INVENTOR(S) : WILLIAM D. HOVERSON

It is certified that error appears in the above-identified patent and that said Letters Patent is hereby corrected as shown below:

In the Specification:

Column 3, line 57, "fold" should be --folds--;

Column 4, line 31, need space between "The" and "functioning";

Column 6, line 43, "tob" should be --top--.

In the Claims:

Column 9, line 55, "support" should be --supported--;

Column 10, line 51, "claimped" should be --clamped--.

Signed and Sealed this

*Twenty-fifth* Day of *March 1986*

[SEAL]

*Attest:*

DONALD J. QUIGG

*Attesting Officer*

*Commissioner of Patents and Trademarks*